United States Patent [19]

Nishizawa et al.

[11] 4,414,318

[45] Nov. 8, 1983

[54] METHOD OF EXPOSING TO LIGHT FLUORESCENT SCREENS OF COLOR PICTURE TUBES

[75] Inventors: Masahiko Nishizawa; Takashi Fujimura, both of Mobara, Japan

[73] Assignee: Hitachi, Ltd., Tokyo, Japan

[21] Appl. No.: 361,267

[22] Filed: Mar. 24, 1982

[30] Foreign Application Priority Data

Mar. 27, 1981 [JP] Japan ..... 56-43855

[51] Int. Cl.[3] ..... G03C 5/04

[52] U.S. Cl. ..... 430/24; 430/23; 430/396; 354/1

[58] Field of Search ..... 430/23, 24, 396, 30; 354/1; 355/71

[56] References Cited

U.S. PATENT DOCUMENTS 4,271,247 6/1981 Morrell ..... 430/24

*Primary Examiner*—John E. Kittle

*Assistant Examiner*—José G. Dees

*Attorney, Agent, or Firm*—Charles E. Pfund

[57] ABSTRACT

In a method of exposing to light a fluorescent screen of an in-line dot type color picture tube wherein an inner surface of a panel of the tube coated with a photosensitive film, a shadow mask, and a linear type extra-high pressure mercury lamp covered by a shielding plate having an opening are disposed substantially in parallel so as to expose the inner surface of the panel to light passing through apertures of the shadow mask, a plurality of openings are formed in the shield plate with a mutual spacing of $n \times B_p(L/Q)$ where $B_p$ represents a lateral pitch between adjacent apertures of the shadow mask, L a distance between the mercury lamp and the inner surface of the panel, Q a distance between the shadow mask and the inner surface of the panel, and n a positive integer, and the inner surface of the panel is exposed to light from the plurality of openings through the apertures of the shadow mask.

1 Claim, 2 Drawing Figures

METHOD OF EXPOSING TO LIGHT FLUORESCENT SCREENS OF COLOR PICTURE TUBES

BACKGROUND OF THE INVENTION

This invention relates to a method of exposing to light a fluorescent screen of an in-line dot type color picture tube at the time of manufacturing the same.

According to a prior art method of exposing to light a fluorescent screen, light emitted from a linear type (long arc type) extra-high pressure mercury arc lamp is projected on the screen through a reflective mirror and a condenser lens made of quartz. However, this method is defective in that its light utilization efficiency is low and that maintenance is difficult. To eliminate these defects, an improved method has been proposed in which an arc in an extra-high pressure type mercury arc lamp is used directly as a light source. The latter type is classified into two versions. In one type, a short arc type extra-high pressure mercury arc lamp is used having an electrode spacing of 1 to 2 mm. Although this type has a high light utilization efficiency, it is difficult to assure repetitious positioning of the light source at a correct position. Accordingly, the other type is commonly used in which a shielding plate is wrapped about a linear type extra-high pressure mercury lamp. An extra-high pressure mercury arc lamp 1 shown in FIG. 1 which has been used in the prior art method comprises a luminous tube 13 containing main electrodes 11 and 12, anode electrode 14, a cathode electrode 15, a ceramic insulator 16 and an outer tube 17 made of quartz glass. Discharge occurs between main electrodes 11 and 12, the distance therebetween being about 30 to 40 mm. A shielding plate 2 is wrapped about the outer tube 17. A slit 21 having a width W is formed in part of the shielding plate 2, and the light at the slit 21 is used as a light source 3.

As described above, since in the prior art exposure method utilizing the linear type extra-high pressure mercury arc lamp, only a small portion of the arc is utilized as the light source, utilization efficiency of light is low, that is, about 3 times at the most as compared to a collimator system.

SUMMARY OF THE INVENTION

Accordingly, it is an object of this invention to provide an improved method of exposing to light a fluorescent screen of an in-line dot type color picture tube capable of shortening the exposure time by improving the utilization efficiency of light from a light source of a linear type extra-high pressure mercury arc lamp.

According to this invention, there is provided a method of exposing to light a fluorescent screen of an in-line dot type color picture tube wherein an inner surface of a panel of the tube coated with a photosensitive film, a shadow mask, and a linear type extra-high pressure mercury lamp covered by a shielding plate having an opening are disposed substantially in parallel so as to expose the inner surface of the panel to light passing through apertures of the shadow mask, characterized by the steps of forming a plurality of openings in the shielding plate with a mutual longitudinal spacing of $n \times B_p(L/Q)$, where $B_p$ represents a lateral pitch between adjacent apertures of the shadow mask, L a distance between the mercury lamp and the inner surface of the panel, Q a distance between the shadow mask and the inner surface of the panel and n a positive integer when the length of the mercury lamp lies in the lateral pitch direction of the shadow mask; and exposing said predetermined areas on the inner surface of the panel to light from the plurality of openings through the apertures of the shadow mask thereby increasing exposure by said plurality.

DESCRIPTION OF THE PREFERRED EMBODIMENT

Figure 1:
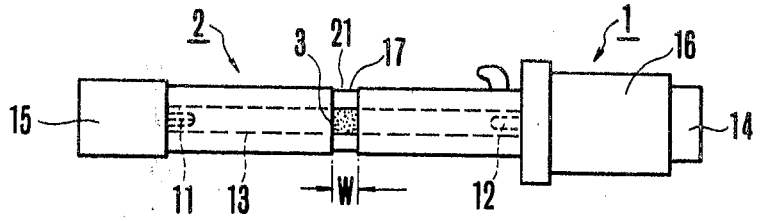
FIG. 1 is a side view showing a linear type extra-high pressure mercury arc lamp utilized in a prior art method of exposing to light a fluorescent screen of a color picture tube.
Figure 2:
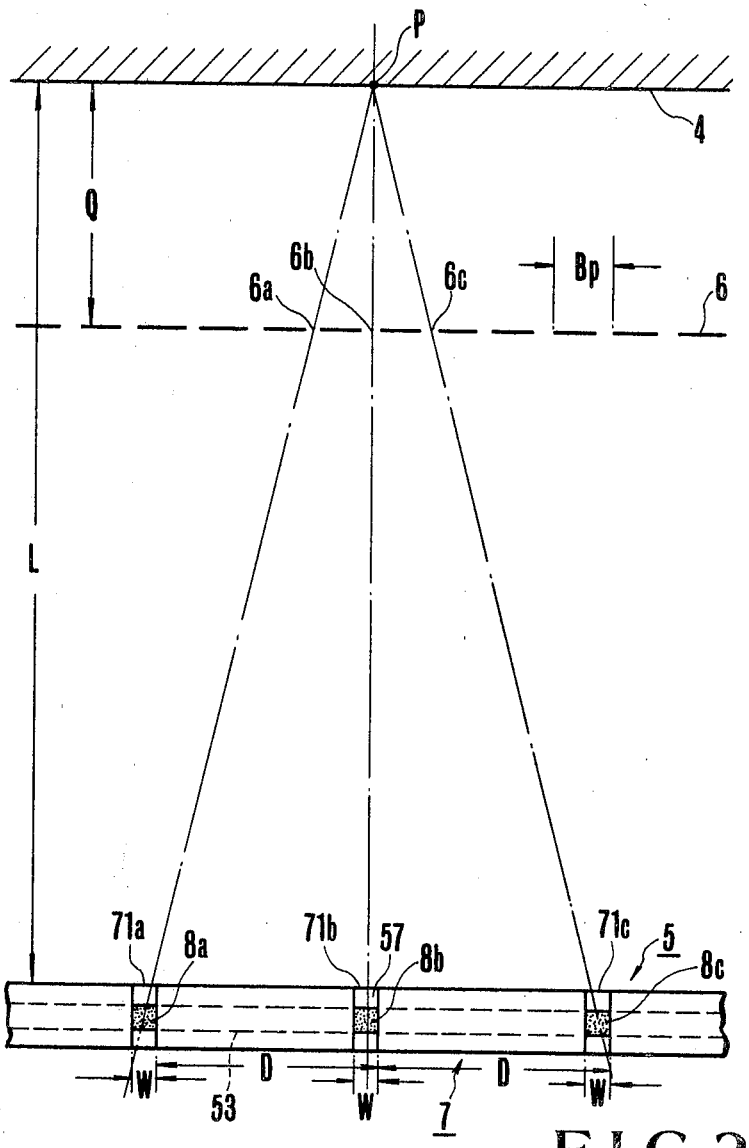
FIG. 2 is a diagram showing a state of exposure according to one embodiment of the method of exposing to light a fluorescent screen of a color picture tube of this invention.

With reference to FIG. 2, a linear type extra-high pressure mercury lamp 5 is disposed at a position spaced by L from the inner surface 4 coated with a photosensitive film, not shown, and a shadow mask 6 utilized as an exposure mask is disposed at an intermediate point between the linear type extra-high pressure mercury lamp 5 and the inner surface 4 of the panel at a point spaced by Q from the inner surface 4. The shadow mask 6 is provided with a number of apertures at a lateral pitch of $B_p$. The inner surface 4 of the panel, the linear type extra-high pressure mercury lamp 5 and the shadow mask 6 are disposed substantially in parallel with each other. The length of the mercury lamp 5 lies in the lateral pitch direction. A shielding plate 7 is wrapped about the outer tube 57 of the mercury lamp 5 and provided with a number of longitudinally spaced slits 71*a*, 71*b* and 71*c* at a spacing of $D=B_p L/Q$, respective slits having a width of W and acting as light sources 8*a*, 8*b* and 8*c*.

When the linear type extra-high pressure mercury arc lamp 5 is used to irradiate the inner surface 4 of the panel, light emitted from 3 light sources 8*a*, 8*b* and 8*c* which are arranged on a straight line along the axis of the mercury lamp expose a single point P on the inner surface 4 of the panel through three mask apertures 6*a*, 6*b* and 6*c* of the shadow mask 6 having a lateral spacing of $B_p$. Since the intensity of arc is uniform between a pair of main electrodes, not shown, on the opposite ends of the luminous tube 53 of the mercury tube 5, it is possible to obtain the intensity of light exposure which is three times of that of a lamp having only one opening.

The above-described parameters $B_p$, L and Q are determined in accordance with the type of the color picture tube. For example, since in a 20 inches, 90° deflection type fine display color picture tube, $B_p=0.3$ mm, $L=289.5$ mm and $Q=9.2$ mm, the shielding plate 7 covering a linear type extra-high pressure mercury tube 5 having a spacing of 30 mm between the main electrodes may be provided with 3 openings 71*a*, 71*b* and 71*c* each having a width of W at a spacing of $D=9.4$ mm. While these parameters are those at the central portion of the color picture tube, it should be understood that the same principle is also applicable at the peripheral portion of the tube.

Although, in the foregoing embodiment, the shielding plate 7 was provided with 3 openings at a spacing of $D=B_p(L/Q)$, it should be understood that the invention is not limited to this construction and that where it is possible to form two or more openings, the mutual spacing can be expressed by the following general equation:

$$D = n \times B_p(L/Q)$$

where n represents a positive integer.

As described above, according to the method of exposing to light a fluorescent screen of a color picture tube of this invention, a plurality of openings are formed in a shielding plate covering a linear type extra-high pressure mercury arc lamp, and the spacing of the openings is selected to be $n \times B_p(L/Q)$ just described so that the same point on the inner surface of the panel can be simultaneously exposed to light from the plurality of openings.

Accordingly, when compared with a prior art method utilizing only one opening, it is possible to increase the utilization efficiency of light. Moreover, since the intensity of light exposure is increased in proportion to the number of openings it is possible to shorten the exposure time.

What is claimed is:

1. In a method of exposing to light a fluorescent screen of an in-line dot type color picture tube wherein an inner surface of a panel of said tube coated with a photosensitive film, a shadow mask, and a linear type extra-high pressure mercury lamp covered by a shielding plate having an opening are disposed substantially in parallel so as to expose predetermined areas on the inner surface of said panel to light passing through apertures of said shadow mask, said method comprising:

forming a plurality of openings in said shielding plate with a mutual longitudinal spacing of $n \times B_p(L/Q)$ where $B_p$ represents a lateral pitch between adjacent apertures of said shadow mask, L a distance between said mercury lamp and the inner surface of said panel, Q a distance between the shadow mask and the inner surface of the panel, and n a positive integer when the length of said mercury lamp lies in the lateral pitch direction of the shadow mask; and exposing said areas on the inner surface of the panel to light from the plurality of said openings through the apertures of said shadow mask thereby increasing exposure efficiency corresponding to said plurality.

* * * * *